United States Patent [19]

Stutznäcker

[11] Patent Number: 4,630,560

[45] Date of Patent: Dec. 23, 1986

[54] DEVICE FOR STABILIZING THE NEEDLE THREAD LOOP IN SEWING MACHINES

[75] Inventor: Klaus Stutznäcker, Frechen-Königsdorf, Fed. Rep. of Germany

[73] Assignee: Nahmaschinenfabrik Emil Stutznacker GmbH & Co. KG, Cologne, Fed. Rep. of Germany

[21] Appl. No.: 192,963

[22] Filed: Oct. 2, 1980

[30] Foreign Application Priority Data

Oct. 2, 1979 [DE] Fed. Rep. of Germany ..... 2939888

[51] Int. Cl.[4] ..... B65H 57/24; D05B 57/00

[52] U.S. Cl. ..... 112/302; 112/154; 112/166; 112/DIG. 3

[58] Field of Search ..... 112/154, 166, 187, 255, 112/301, 302, DIG. 3

[56] References Cited

U.S. PATENT DOCUMENTS 50,117 9/1865 Hale ..... 112/154 X 3,333,560 8/1967 Wiener et al. ..... 112/154 X 3,340,838 9/1967 Morris ..... 112/154 X

FOREIGN PATENT DOCUMENTS 2745976 4/1979 Fed. Rep. of Germany ... 112/DIG. 3

2745977 4/1979 Fed. Rep. of Germany ... 112/DIG. 3

521754 3/1955 Italy ..... 112/154

*Primary Examiner*—W. C. Reynolds

*Attorney, Agent, or Firm*—Collard, Roe & Galgano

[57] ABSTRACT

A device for stabilizing the needle thread loop in the area of the looper in sewing machines and, in particular, in sewing machines having a plurality of needles, is provided wherein a compressed air stream flows substantially transverse to the movement path of the part which contains the needle thread loop. Two compressed air nozzles are provided for each needle which are positioned at the side of the needle facing away from the needle thread loop in such a manner that the compressed air streams meet in the area of the needle thread loop.

6 Claims, 8 Drawing Figures

FIG. 2
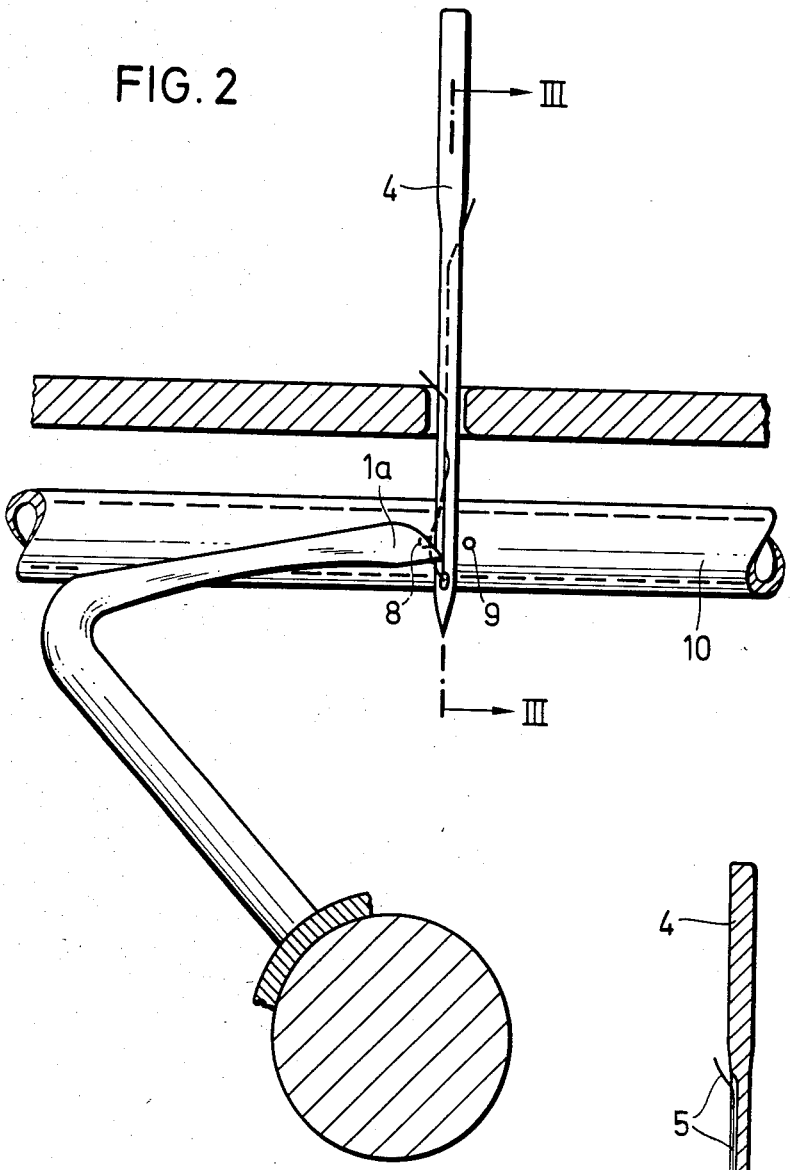
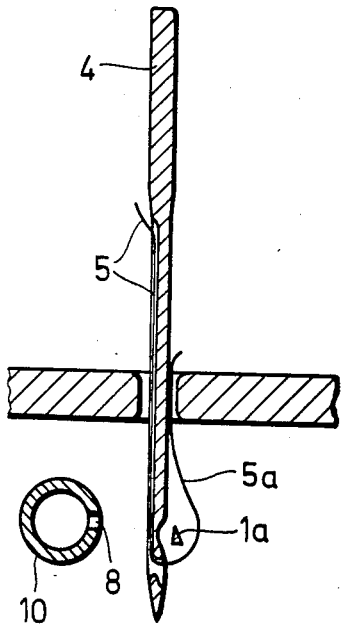
FIG. 3

DEVICE FOR STABILIZING THE NEEDLE THREAD LOOP IN SEWING MACHINES

The invention relates to a device for stabilizing the needle thread loop in the area of the looper in sewing machines. More particularly, it relates to such a device for sewing machines having a plurality of needles which provides a compressed air stream flow which flows substantially transverse to the movement path of the part which contains the needle thread loop.

The safety of sewing in sewing machines depends substantially on the efficient shaping of the needle thread loop which must be caught by the looper or gripper, so as to be coupled with the so-called lower thread by means of further sewing tools. The shaping of the needle thread loop of the upper thread is carried out during the so-called loop stroke, i.e., after the needle has run through its deepest position and then carries out a stroke (of mostly only millimeters) in an upward direction. In this stroke position the tip of the looper pierces the inner space of the needle thread loop. If the needle thread loop is too small at this moment, the danger exists that the looper tip pierces the needle thread loop itself and damages the needle thread, or the looper top runs below the needle thread loop on the outside thereof. Should the needle thread loop be too large, the danger exists that the loop tilts, so that the looper tip either hits the needle thread directly and damages the thread, or it passes by the thread on the outside of the loop. In all cases, incorrect stitches or thread breaks result.

A device of the aforementioned type is disclosed in U.S. Pat. No. 3,333,560. However, in this device only one compressed air stream is provided which is discharged from a nozzle and is directed toward the needle. A substantial disadvantage of this device is that this single air stream is interrupted by the looper in its path to the corresponding thread loop of the needle. This takes place, in particular, at the moment when the thread loop should be very stable, so that the thread loop is consequently not sufficiently stabilized.

It is therefore an object of the invention to provide a device for stabilizing the needle thread loop in the area of the looper in sewing machines, in particular in sewing machines having a plurality of needles which permits, in a simple manner, the forming of a large needle thread loop without the danger of tilting, so that the stabilization thereof is assured, independent of the movements of the needle and the looper.

This object of the invention is obtained by the provision of two compressed air nozzles for each needle which are positioned at the side of the needle facing away from the needle thread loop which are oriented in such a manner that the compressed air streams are directed toward and, preferably, meet in the area of the needle thread loop. Due to the fact that the compressed air streams meet within the area of the needle thread loop, the needle thread loop is not only pulled in a relatively large loop but is also supported and guided from two sides, so that the loop cannot pivot or tilt to either side. In addition, a very important and surprising effect is obtained in that, at the moment the pivotable looper enters into the needle thread loop, the compressed air nozzle which is positioned on the looper side is covered by the looper and is rendered ineffective to a large extent. However, at that moment, the second compressed air nozzle is especially effective and the compressed air pressure which discharges from this compressed air nozzle pushes the needle thread loop onto the looper, so that the looper grips the needle thread loop with the highest degree of safety.

Other objects and features of the present invention will become apparent from the following detailed description when taken in connection with the accompanying drawings which disclose several embodiments of the invention. It is to be understood that the drawings are designed for the purpose of illustration only and are not intended as a definition of the limits of the invention.

In the drawings, wherein similar reference characters denote similar elements throughout the several views:

FIG. 2 is a view comparable to that of FIG. 1 but showing the needle position at the point at which the needle thread loop has been formed and the looper engages the same;

FIG. 3 is a sectional view taken along line III—III of FIG. 2;

Figure 1:
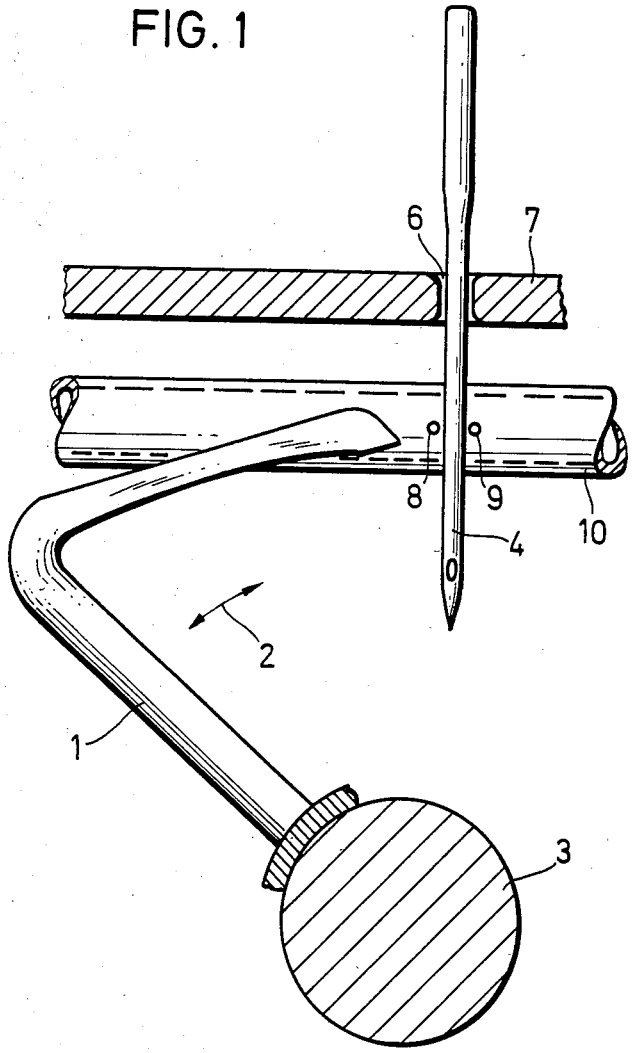
FIG. 1 is a schematically-illustrated side elevational view, of a first embodiment of the invention, in part section, of a looper as well as the needle at its lowermost needle position, and with two compressed air nozzles, embodying the present invention.

Referring now in detail to the drawings, FIGS. 1 to 3 illustrate one embodiment of the invention wherein a looper or gripper 1 is reciprocally pivoted around the pivot axis 3 in the direction of arrow 2 in a sewing machine; this movement being synchronized with the vertical movement path of a needle 4. Needle 4 guides an upper thread 5 through the stitch opening 6 of a stitch plate 7 in a downward movement until it reaches its lowermost position in accordance with FIG. 1. When needle 4 moves upwardly to a position shown in FIG. 2, the needle thread loop 5*a* is formed.

As can be seen best in FIG. 2, tip 1*a* of looper 1 engages the needle thread loop 5*a*. At the side of each needle 4 facing away from the needle thread loop, two compressed air nozzles 8, 9 are provided. These two compressed air nozzles 8, 9 are so arranged that the compressed air streams meet in the area of needle thread loop 5*a*.

Compressed air nozzles 8, 9 are basically positioned such that they are spaced apart from one another and from needle 4 with respect to the vertical plane through which needle 4 and the center position of the needle thread loop 5*a* pass, which corresponds to the plane of the sectional view shown in FIG. 3; i.e., the nozzles are located on opposite sides of a vertical plane passing through the center of one side of the needle facing the needle thread loop and the opposite side of the needle facing away from the needle thread loop.

Figure 4:
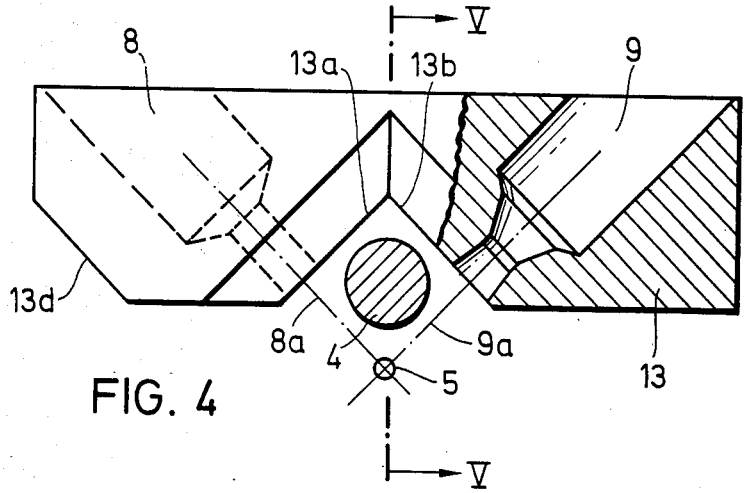
FIG. 4 is an enlarged plan view, of a second embodiment of the invention, in part section, of a fitting in which the two compressed air nozzles are incorporated.
Figure 5:
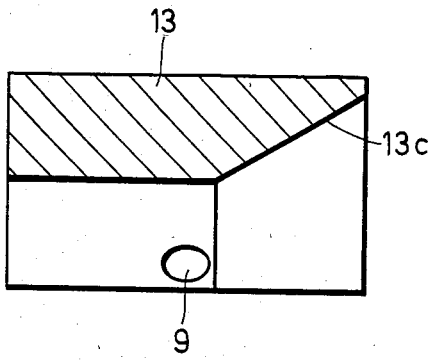
FIG. 5 is a cross-sectional view taken along line V—V of FIG. 4.
Figure 6:
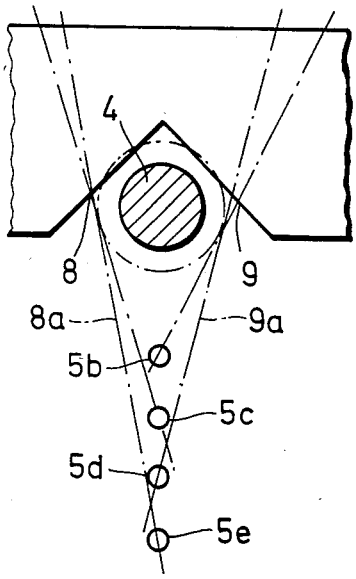
FIG. 6 is a view of different angle positions of the compressed air nozzles in a fitting of the type shown in FIG. 4.

The two compressed air nozzle 8, 9 are advantageously disposed at such an angle, with respect to each other, that the compressed air streams, which are shown in simplified dash-dotted lines 8*a* and 9*a* in FIGS. 4 and 6, meet in a converging manner, as the advantageous structures of FIGS. 4, 5 and 6 show. Basically, the two compressed air nozzles 8, 9 may be positioned at both sides of the aforementioned plane corresponding to the plane of section line V—V of FIG. 4 at an angle range of about −11° to 45° (the angle range applies to one nozzle relative to the plane). In the embodiment of FIG. 4, this angle is about 45°, while in FIG. 6, smaller angles, for example of −11° to +11°, 14°, 21° or 26° are possible and advantageous, depending on the desired dimension of the needle thread loop. As shown in FIG. 6, a smaller angle. for the two compressed air nozzles is suitable for a particularly large needle thread loop 5*e*, while at a larger angle the needle thread loop is smaller, as shown by reference numerals 5*b*, 5*c* and 5*d*.

Figure 7:
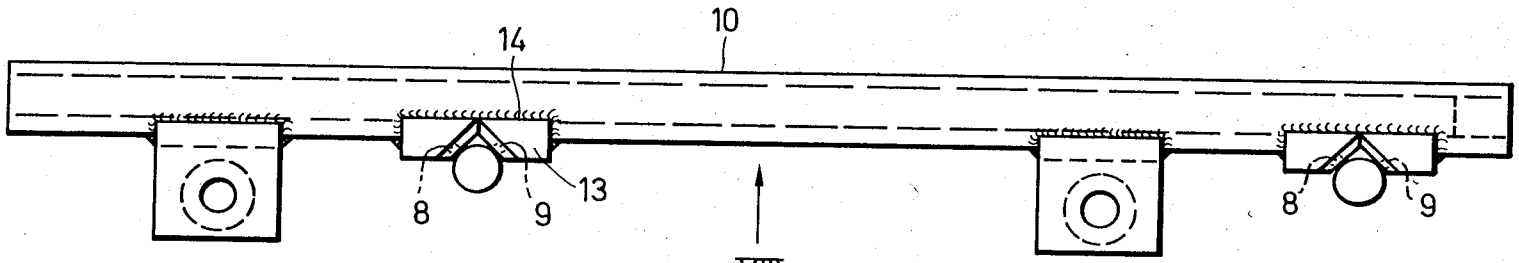
FIG. 7 is a plan view of a compressed air common pipeline commonly having a plurality of compressed air nozzles.
Figure 8:
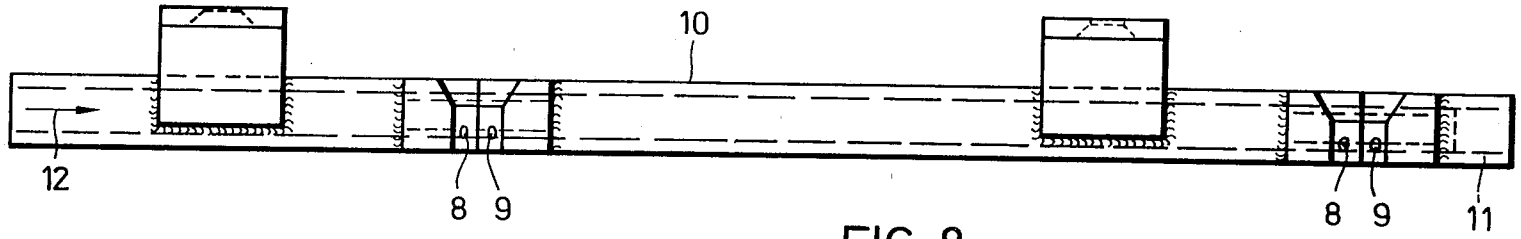
FIG. 8 is a side view of the pipeline taken in the direction of arrow VIII in FIG. 7.

As can be seen in FIGS. 7 and 8, compressed air nozzles 8, 9 may be advantageously mounted in pairs for each needle on a common compressed air pipeline 10 which may be closed at one end with a plug 11, or the like, and which, at its other end is coupled with a compressed air supply (not shown), so that the compressed air moves in the direction of the arrow 12 (FIG. 8). In the embodiment shown in accordance with FIGS. 7 and 8, only two pairs of compressed air nozzles are mounted on the common pipeline 10. However, in sewing machines having a plurality of needles one may have to accommodate a large number of needles, if need be, e.g., about one hundred or more needles in each row. As FIGS. 7 and 8 show, and in particular FIGS. 4 and 5, the two compressed air nozzles 8, 9 for each needle are provided in a common fitting 13, each of which is mounted in a corresponding cut-out portion 14 (FIG. 7) of the common compressed air pipeline 10. The fitting 13 may have the shape shown in FIGS. 4 and 5. When the fittings 13 are made from metal they may be mounted in cut-out portion 14 by means of soldering, for example. However, it is also advantageous to make the fitting from a suitable wear-resistant and pressed ceramic material, which facilitates the making of a large number of fittings and which permits an exact making of the nozzles. In this case, one could mount the numerous fittings onto the compressed air pipeline by means of a bonding agent.

In the embodiment of FIG. 4, the compressed air nozzles 8, 9 discharge from the rectangular cut-out faces 13*a*, 13*b*. Needle 4 projects into this rectangular cut-out portion so that the compressed air streams meet behind needle 4 in the area of thread loop 5. The oblique face 13*c* (FIG. 5) is provided for safety reasons so that the needle tip does not engage the upper side of fitting 13. The oblique face 13*d* (FIG. 4) serves the same purpose with respect to looper 1. Preferably, the compressed air pressure nozzles 8, 9 are Laval nozzles, as shown in the right section of FIG. 4, so as to obtain a precisely focused air stream.

The effectiveness of the invention device is particularly shown in FIG. 2. After forming the needle thread loop 5*a*, i.e., after the needle moves upwardly into the position of FIG. 2, the compressed air nozzle 8 is substantially covered by the looper, so that air stream issuing therefrom cannot contact the needle thread loop 5*a* during this brief time period. During this period the second compressed air nozzle 9 is particularly effective, so that the needle thread loop in accordance with FIG. 2 is pivoted into the position shown in dash-dotted line and is pushed effectively over the looper tip.

In the aforementioned embodiments which are shown in the drawings, the compressed air pressure nozzles are arranged at such a positive angle with respect to each other, that the air streams meet in a converging manner. Instead, a smaller negative angle may be chosen, so that the air pressure streams do not meet but flow by, at the sides of the needle thread loop. In this case, the compressed air streams generate a suction effect in the intermediate area which also provides a stabilization effect for the needle thread loop.

Thus, while only several embodiments of the present invention have been shown and described, it will be obvious that many changes and modifications may be made thereunto, without departing from the spirit and scope of the invention.

What is claimed is:

1. A device for stabilizing a needle thread loop in the area of a looper in sewing machines having at least one needle for forming a needle thread loop on one side thereof, comprising:

two compressed air nozzles for each needle which are positioned on the opposite side of the associated needle facing away from the needle thread loop and which are oriented in such a manner that the compressed air streams emanating therefrom are directed toward the area of the needle thread loop, said compressed air nozzles being spaced apart from each other and from said needle and being located on opposite sides of a vertical plane passing through the center of said one side and said oppoiste side of said needle in an angular range of from about +5 degrees to about about +45 degrees with respect to said plane.

2. The device according to claim 1, wherein a multiplicity of said compressed air nozzles are provided in pairs on a common air pressure pipeline.

3. The device according claim 2, wherein a multiplicity of said pairs of compressed air nozzles for each needle are mounted on a common fitting which is mounted in a cut-out portion of the common compressed air pipeline.

4. The device according to claim 3, wherein said fitting comprises a wear-resistant and pressed ceramic material.

5. The device according to claim 1, wherein said compressed air nozzles are in the form of Laval nozzles.

6. A device for stabilizing a needle thread loop in the area of a looper in sewing machines having at least one needle for forming a needle thread loop on one side thereof, comprising:

two compressed air nozzles for each needle which are positioned on the opposite side of the associated needle facing away from the needle thread loop and which are oriented in such a manner that the compressed air streams emanating therefrom meet in a converging manner and are directed toward the area of the needle thread loop, said compressed air nozzles being spaced apart from each other and from said needle and being located on opposite sides of a vertical plane passing through the center of said one side and said opposite side of said needle.

* * * * *